US006189185B1

(12) United States Patent
Bioul et al.

(10) Patent No.: US 6,189,185 B1
(45) Date of Patent: Feb. 20, 2001

(54) METHODS AND DEVICES FOR PRODUCING A STREAMLINED LAP AND A CONTINUOUS TEXTILE PRODUCT

(75) Inventors: Jean-Pierre Bioul, Sedan; Michel Pene, Mouzon; Bernard Jourde, Elbeuf; Robert Jean, Fouqueville, all of (FR)

(73) Assignees: Asselin, Elbeuf; Sommer Industrie, Marckolsheim, both of (FR)

( * ) Notice: Under 35 U.S.C. 154(b), the term of this patent shall be extended for 0 days.

(21) Appl. No.: 09/367,686

(22) PCT Filed: Feb. 16, 1998

(86) PCT No.: PCT/FR98/00287

§ 371 Date: Aug. 19, 1999

§ 102(e) Date: Aug. 19, 1999

(87) PCT Pub. No.: WO98/37264

PCT Pub. Date: Aug. 27, 1998

Related U.S. Application Data

(63) Continuation-in-part of application No. 08/843,508, filed on Apr. 16, 1997, now abandoned.

(30) Foreign Application Priority Data

Feb. 19, 1997 (FR) ..... 97 01937

(51) Int. Cl.[7] ..... D04H 3/05
(52) U.S. Cl. ..... 19/163; 19/161.1
(58) Field of Search ..... 19/65 A, 160, 19/161.1, 163, 296, 302; 270/39.01, 40, 39.05, 41

(56) References Cited

U.S. PATENT DOCUMENTS

| | | | | |
|---|---|---|---|---|
| Re. 35,982 | * | 12/1998 | Freund | 19/163 |
| 3,660,867 | | 5/1972 | Watson . | |
| 3,673,757 | | 7/1972 | Willis . | |
| 3,875,616 | | 4/1975 | Trott . | |
| 4,107,822 | | 8/1978 | Brown . | |
| 4,186,470 | * | 2/1980 | Stoller | 19/161.1 |
| 4,984,772 | | 1/1991 | Freund . | |
| 5,353,477 | * | 10/1994 | Hille | 19/163 |
| 5,373,610 | | 12/1994 | Jean et al. . | |
| 5,400,475 | * | 3/1995 | Hille | 19/163 |

FOREIGN PATENT DOCUMENTS

| | | |
|---|---|---|
| 100 658 | 4/1898 | (DE) . |
| 42 34 354 | 4/1994 | (DE) . |
| 195 27 416 | 1/1997 | (DE) . |
| 0 609 907 | 8/1994 | (EP) . |

* cited by examiner

*Primary Examiner*—John J. Calvert
*Assistant Examiner*—Gary L. Welch
(74) *Attorney, Agent, or Firm*—Young & Thompson

(57) ABSTRACT

The invention concerns a stretcher comprising a carriage (21) subjected to a back-and-forward motion (2) for depositing in successive segments (2*a* . . . 2*d*) a web of fibres (2) on an outgoing conveyor (6) moving along a direction (9). In order to produce ranges of different plies in the transverse profile of the lap (4) formed on the outgoing conveyor (6) by the web deposited in mutually overlapping segments, the points of inversion of direction (21) in the backward and forward motion of the carriage are different. As a result the successive folds (2*ab*, 2*cd*; 2*bc*, 2*da*) of the same direction are differently positioned, and the number of web plies in the lap is not the same over the whole width of the lap. The invention is useful for streamlining the lap freely and accurately.

43 Claims, 6 Drawing Sheets

METHODS AND DEVICES FOR PRODUCING A STREAMLINED LAP AND A CONTINUOUS TEXTILE PRODUCT

This application is the 35 USC §371 national stage of international application PCT/FR98/00287 filed on Feb. 16, 1998, which designated the United States of America, and this application is also a continuation-in-part of parent application Ser. No. 08/843,508 filed on Apr. 16, 1997 now abandoned.

The Present invention relates to a method of producing a fibre fleece having a non-uniform thickness profile.

The present invention also relates to a method for producing a continuous textile product having a non-uniform transverse profile.

The present invention also relates to a crosslapper device and a device for producing a continuous textile product for implementing this method.

In order to produce a fibre fleece, intended in general for subsequent processing, in particular a process of consolidation by needling, it is known to use a crosslapper whose function is to produce a zig-zag folding, on an output conveyor, of a web composed of longitudinal fibres.

In this machine, the web is disposed in segments, alternately inclined in one direction and then in the other, which overlap one another. The folds between segments are aligned along the lateral edges of the fleece produced.

Such a fleece generally has a uniform thickness profile over its entire width. FR-A-2 234 395 gives the speed relationships to be complied with in the crosslapper in order to control the thickness of the fleece. According to EP-A-0 315 930, the fleece can have a variable thickness profile by varying the speed of the carriage, which deposits the web on a variable point in the width of the output conveyor belt, with respect to the speed of the conveyor belts which carry the web up to this carriage. If, at a given position in the width of the fleece, the carriage moves at a speed greater than that at which it feeds the web, the web is stretched and this reduces the thickness of the fleece at that place. If, on the contrary, the speed of the carriage is less than the feed speed, the web is deposited in a compressed form which increases the thickness of the fleece at that place.

This method of profiling the fleece has certain limitations. The stretchings and compressions of the web cannot be positioned accurately because there is a distance between the place at which the web leaves the carriage and the place at which it is deposited on the output conveyor. Furthermore, particularly with certain types of fibres, the tensile or compressive stresses imposed on the web tend to be transmitted to certain regions of the web deposited just before or just after the zone for which a predetermined tension or compression is desired. Finally, the tension or compression imposed on the web cannot exceed certain limits without risks.

The documents DE-C-100 658 and DE-A-195 27416 describe methods in which two successive crosslappings are performed. For avoiding that the longitudinal edges of the first fleece form transverse edges on the second fleece, said longitudinal edges are realized as bevelled edges. Therefore, some of the folds between segments of the first crosslapping are slightly offset sidewardly inwardly of the first fleece. The purpose of this arrangement is to obtain a final textile product having a uniform longitudinal profile. The product resulting from the second crosslapping has a uniform transverse profile.

The document DE-A-42 34 354 discloses the deposition of elementary fibre webs, thereby to imbricate the elementary webs with respect to each other. The result is a reduced thickness and weight per unit of area along the edges, which have to be eliminated by a cut, designated by the reference letter "T", whereby the product which is thereafter subjected to needling has a uniform transverse profile.

The purpose of the present invention is to propose a method and a device for producing more efficiently a fibre fleece and a continuous textile product having a non-uniform, in particular stepped thickness profile and/or profile of weight per unit of area over the width of the fleece.

According to a first aspect of the invention, the method of producing a fibre fleece by depositing on an output conveyor successive transverse segments of web connected to one another by folds produced alternately in one direction and then in the other by reversal of the transverse direction in which the web is deposited, wherein there is positioned at different locations in the width of the output conveyor at least certain of the successive folds of the same direction, is characterized in that folds positioned along at least one line located between side edges of the fleece form a shoulder between two longitudinal zones of the fleece.

According to a second aspect of the invention, the method of producing a continuous textile product provided with a transverse profile having a non-uniform thickness, comprising the step of forming a fibre fleece by depositing on an output conveyor successive transverse segments of web connected to one another by folds produced alternately in one direction and then in the other by reversal of the transverse direction in which the web is deposited, wherein there is positioned at different locations in the width of the output conveyor at least certain of the successive folds of the same direction, is characterized in that the non-uniform profile of the fibre fleece is substantially kept along a transverse direction of the continuous textile product until the end of a subsequent step of consolidation.

The term "amplitude" of a segment will refer to the distance between the two folds delimiting that segment.

According to the invention, the successive segments can have different amplitudes and all of them do not cover the same region of the width of the output conveyor. The number of superimposed web layers is not the same in all of the regions of the width of the fleece. As the position of the folds can be chosen with relatively high accuracy, the profile of the fleece obtained distinctly and accurately complies with the theoretically desired profile.

The invention is particularly suitable for producing a fleece whose profile has at least one relatively sudden variation in thickness profile.

However, it is possible to soften the changes in thickness by slightly offsetting, with respect to one another, the folds of the same direction located at the limit between two zones having different thicknesses.

In order to produce an extra thickness between two thinner zones, it is possible to produce segments which cover only the extra thickness, and therefore limited by a fold along each of the longitudinal edges of the extra thickness, and other folds of greater amplitude covering the extra thickness and the two thinner adjacent zones. But it is also possible to produce an extra thickness between two thinner zones without forming any segment whose amplitude coincides with the width of the extra thickness. In order to do this, certain segments are produced starting from an edge of the extra thickness and covering the latter and the thinner zone adjacent to the other edge, and other segments starting from the said other edge and covering the extra thickness and the other thinner zone. This is convenient for making very narrow extra thicknesses, in the form of ribs.

According to another aspect of the invention, the crosslapper comprising:

an output conveyor;

a carriage which is transversely mobile above the output conveyor;

means of actuating the carriage to move in accordance with travels in each direction of the width of the output conveyor, separated by reversals of travelling direction;

means of supplying the carriage with a continuous web;

means carried by the carriage for feeding the web onto the output conveyor; and means of profiling the fleece produced on the output conveyor, for providing the produced fleece with a stepped transverse profile is characterized in that the profiling means comprise means of positioning at different locations in the width of the output conveyor at least certain of the successive reversals in the travelling direction of the carriage starting from a same travelling direction of the carriage, thereby to define over the width of the fleece at least two zones of different thickness which are separated by at least one shoulder.

According to a still further aspect of the invention, the device for producing a continuous textile product, comprising:

a crosslapper, a consolidation machine positioned downstream thereof, means for guiding the fleece from the crosslapper to the consolidation machine;

the crosslapper comprising :

an output conveyor;

a carriage which is transversely mobile above the output conveyor;

means of actuating the carriage to move in accordance with travels in each direction of the width of the output conveyor, separated by reversals of travelling direction;

means of supplying the carriage with a continuous web;

means carried by the carriage for feeding the web onto the output conveyor; and means of profiling the fleece produced on the output conveyor, the guiding means being so arranged that the transverse profile of the fleece travelling out of the crosslapper is in a transverse orientation in the path through the consolidation machine, is characterized in that the profiling means comprise means of positioning at different locations in the width of the output conveyor at least certain of the successive reversals in the travelling direction of the carriage starting from a same travelling direction of the carriage.

Other features and advantages of the invention will furthermore emerge from the following description, given with reference to non-limitative examples.

Figure 1:
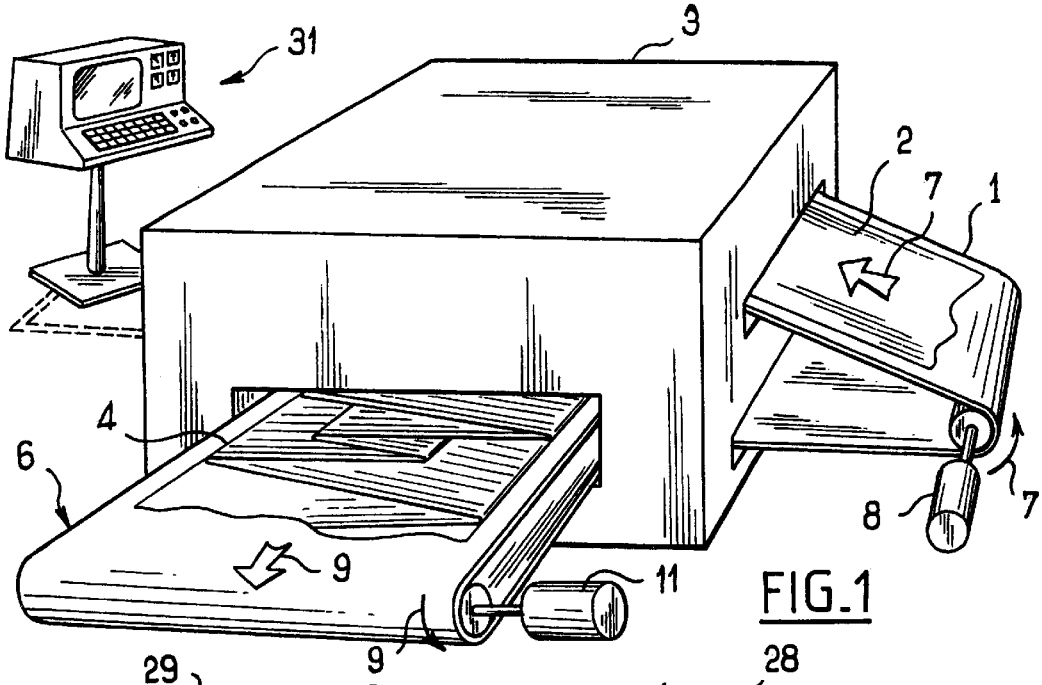
FIG. 1 is a perspective view of a crosslapper according to the invention.

The crosslapper shown in perspective in FIG. 1 comprises a supply conveyor belt 1 which picks up the fibre web 2 coming for example from a card, which is not shown, and transports it into the enclosure 3 of the crosslapper, where the web is converted by folding into a fleece 4 emerging from the enclosure 3 by means of an output conveyor 6. The supply conveyor belt 1 is driven at a speed, which is typically a constant speed in the direction of the arrows 7 causing the fibre web 2 to enter the enclosure 3, by means of an electric motor 8. The output conveyor 6 is driven in the direction of the arrows 9, causing the fleece 4 to emerge from the enclosure 3, by means of an electric motor 11. The speed of rotation of the motor 11 can be constant or, as a variant, can for example vary as described in FR-A-2 234 395.

Inside the enclosure 3 there is installed another conveyor belt—or rear conveyor belt—12 which is driven in rotation by an electric motor 13 coupled to a fixed cylinder 14 for guiding the conveyor belt 12. Over a section of their paths inside the enclosure 3, the supply conveyor belt 1 and the rear conveyor belt 12 are adjacent to one another in order to form together a pinching zone 16 in which the fibre web 2 is held between the conveyor belts 1 and 12. In the pinching zone 16, the conveyor belts 1 and 12 move at the same speed because of a matched control of the motors 8 and 13.

The pinching zone 16 ends between a guide cylinder 17 supporting the supply conveyor belt 1 and a guide cylinder 18 supporting the rear conveyor belt 12, which between them define a feed slot for the web 2 opening downwards above the output conveyor 6. Seen from above, the longitudinal direction of the supply conveyor belt 1 and of the rear conveyor belt 12 is perpendicular to the longitudinal direction of the output conveyor 6. The feed slot 19 is therefore parallel with the longitudinal direction of the output conveyor 6. The path followed by the supply conveyor belt 1 and the rear conveyor belt 12 inside the enclosure 3 is not shown in its entirety because it can assume any known form whatsoever, for example according to FR-A-2 234 395, EP-A-0 517 563, FR-A-2 553 102 etc. . . . .

Figure 2:
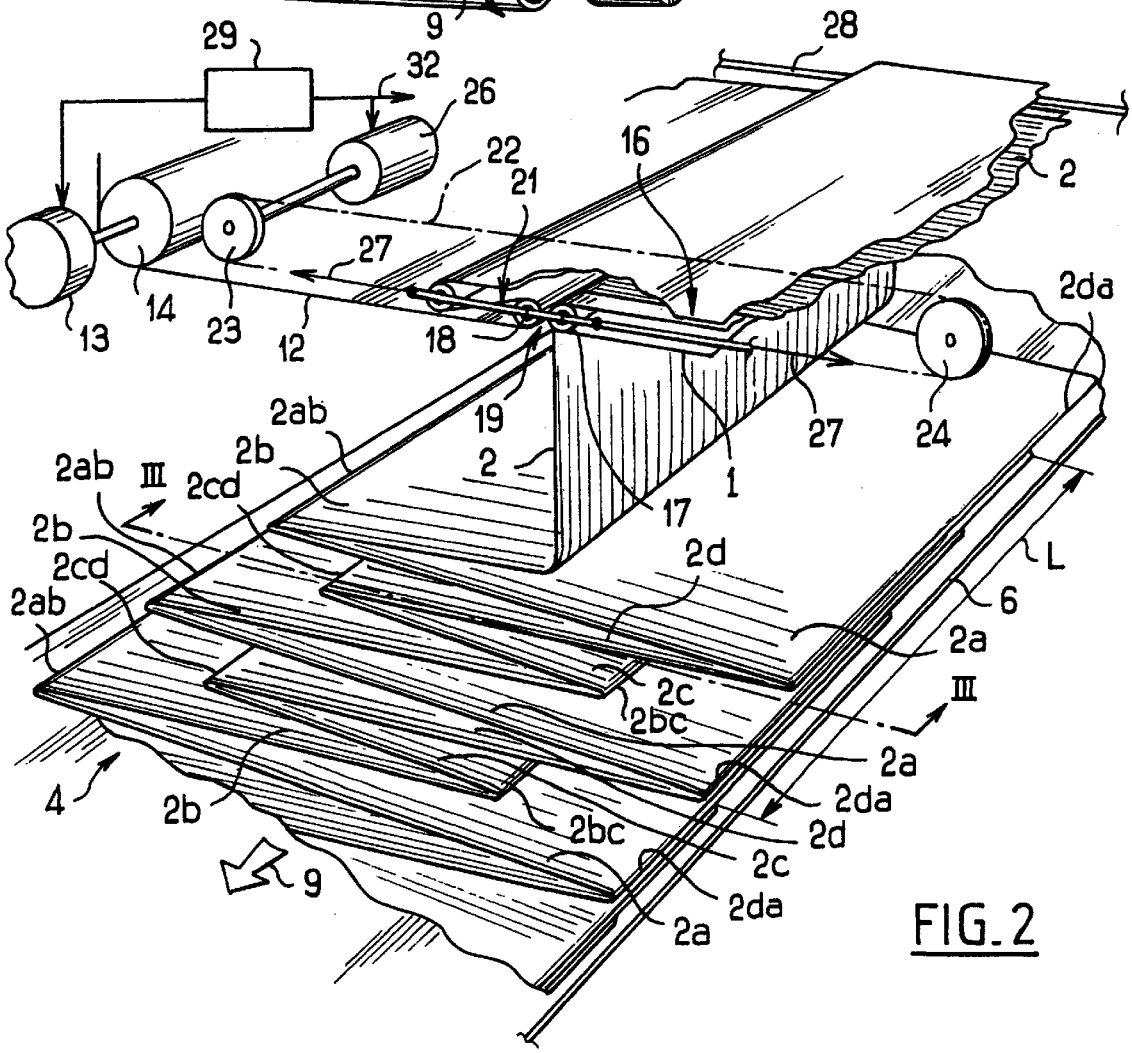
FIG. 2 is a partial diagrammatic view of the lapping carriage and of the output conveyor of the crosslapper shown in FIG. 1 and in operation.

The two cylinders 17 and 18 defining the feed slot 19 are carried by a lapping carriage 21 which is shown only very diagrammatically in FIG. 2. The carriage 21 is coupled to a drive means 22 such as an endless notched belt passing round two return pulleys 23, 24. One 23 of the pulleys is connected to the shaft of an electric drive motor 26 capable of operating in both directions in order to be able to move the carriage 21 in a forward and backward motion parallel with the transverse direction of the output conveyor 6 as illustrated by the arrows 27. Two guide rails, only one of which 28 is shown in FIG. 2 in order to simplify this figure, can be provided on each side of the conveyor belts 1 and 12 in order to support and guide the carriage 21 in its forward and backward motion indicated by the arrows 27. In a way which is not shown, the carriage 21 can comprise rollers rolling in the rails 28. Any other appropriate means of guidance can be envisaged.

The motor 26 for driving the lapping carriage 21 is controlled by a control unit 29 which is itself connected to or forms part of a programming console 31 (FIG. 1). The control unit 29 defines the speed of the motor 26 at all times and therefore controls both the amplitude of the forward and backward motion of the lapping carriage 21 and the speed and acceleration laws of the carriage, particularly during the slowing down, stopping and re-acceleration in the opposite direction at each change of direction of the carriage 21.

In a way which is very well known to those skilled in the art, and in particular according to the documents already quoted referring to the prior art, the web 2 follows, between its entry into the enclosure 3 by means of the supply conveyor belt 1 and its emergence through the feed slot 19, a variable-geometry path, which passes through an upper carriage (not shown). The latter carries other cylinders supporting the two conveyor belts 1 and 12, and it is driven in a forward and backward motion parallel with the transverse direction of the output conveyor 6 and therefore parallel with the forward and backward motion of the lapping carriage 21. The purpose of these arrangements is to produce, inside the enclosure 3, a variable accumulation of web 2, in order to achieve an adaptation between the fixed Location at which the web 2 enters the machine at constant speed by means of the supply conveyor belt 1 and the variable location at which the slot 19 feeds the web 2. This adaptation can be achieved by a simple mechanical coupling between the two carriages as described in FR-A-2 553 102. More sophisticated controls described particularly in FR-A-2 234 395 make it possible to establish a variable speed ratio between the two carriages in order to control the thickness of depositing the web 2 on the output conveyor 6 despite the inevitable variations in the absolute speed of the lapping carriage 21. In order to achieve such more sophisticated controls, the mechanical coupling between the two carriages is not provided. Instead of this, the control unit 29 comprises a link 32 with a motor for driving the upper carriage in order to control the upper carriage in a way which is coordinated with the lapping carriage 21. Furthermore, the control unit 29 is connected to the motor 13 in order to control the speed of the rear conveyor belt 12 such that it is equal to the speed of the conveyor belt 1 at all times in the pinching zone 16. FR-A-2 553 102 shows however that in certain machine configurations in which the pinching zone turns around a guide cylinder, the two conveyor belts can be driven by a common motor coupled to this cylinder and appropriately controlled in speed in correlation with the forward and backward movements of the lapping carriage 21.

Whatever technological variant may be used, the combined action of the forward and backward motion of the lapping carriage 21, of the circulation of the conveyor belts 1 and 12, and of the movement of the output conveyor 6 in the direction of the arrow 9, causes the web 2 to be deposited on the output conveyor 6 in a zig-zag pattern formed of successive segments denoted by the references 2*a*, 2*b*, 2*c* and 2*d* in the example shown in FIGS. 1 to 4, each limited by a fold in one direction and a fold in the other direction. The segments extend transversely on the output conveyor while making, however, an angle other than 90° with respect to the longitudinal direction of the output conveyor 6. These successive segments which overlap one another obliquely form the fleece 4. Such a fleece is generally intended to undergo a subsequent consolidation process, such as a needling process (not shown). For example, in FIG. 2, a segment 2*b* is being formed, it started with a fold 2*ab* which separates it from segment 2*a* which has just been completed and it will end with a fold 2*bc* in the other direction, that is to say towards the left, which will separate it from the following segment 2*c*. There are also folds 2*cd*, in the same direction as the folds 2*ab* and separating the segments 2*c* from the segments 2*d*, and folds 2*da* in the same direction as the folds 2*bc* and separating the segments 2*d* from the segments 2*a*. The folds are parallel with the longitudinal direction of the output conveyor 6 and of the fleece 4.

According to the present invention, the folds of the same direction which succeed one another along the fleece 4, instead of being all superimposed along a corresponding lateral edge of the fleece in accordance with the prior art, are on the contrary offset laterally with respect to one another. Thus, in the example shown, the folds 2*ab* on the left of the fleece and 2*da* on the right of the fleece are adjacent to the respective lateral edges of the fleece 4, whilst the folds 2*cd* and 2*bc* are offset towards the inside of the fleece 4.

Still referring to the example shown in FIGS. 1 to 4, the lapping is carried out according to a repetitive pattern comprising the four previously mentioned segments 2*a*, 2*b*, 2*c* and 2*d* defined by the folds 2*da*, 2*ab*, 2*bc* and 2*cd* which delimit them. The repetitive execution of this lapping pattern produces, in the example shown, four rows of folds, corresponding respectively to the folds 2*ab* and 2*da* forming the lateral edges of the fleece 4, and two rows 2*bc* and 2*cd* located at a certain distance from the longitudinal edges of the fleece. In a central zone 4*a* located between the folds 2*bc* and 2*cd* the thickness of the fleece is maximal as all of the segments are present. On the contrary, between the folds of the same direction 2*ab* and 2*cd*, and therefore in a strip 4*b* located along the left edge of the web in FIG. 2, only the segments 2*a* and 2*b* are present. Similarly, in a strip 4*c* adjacent to the right edge of the fleece 4, between the two other types of folds in same direction 2*bc* and 2*da*, and therefore in the opposite direction to the folds 2*ab* and 2*cd*, only the segments 2*d* and 2*a* are present. In these two strips 4*b* and 4*c*, the thickness of the fleece is therefore two times less than in the central zone 4*a*.

Figure 3:
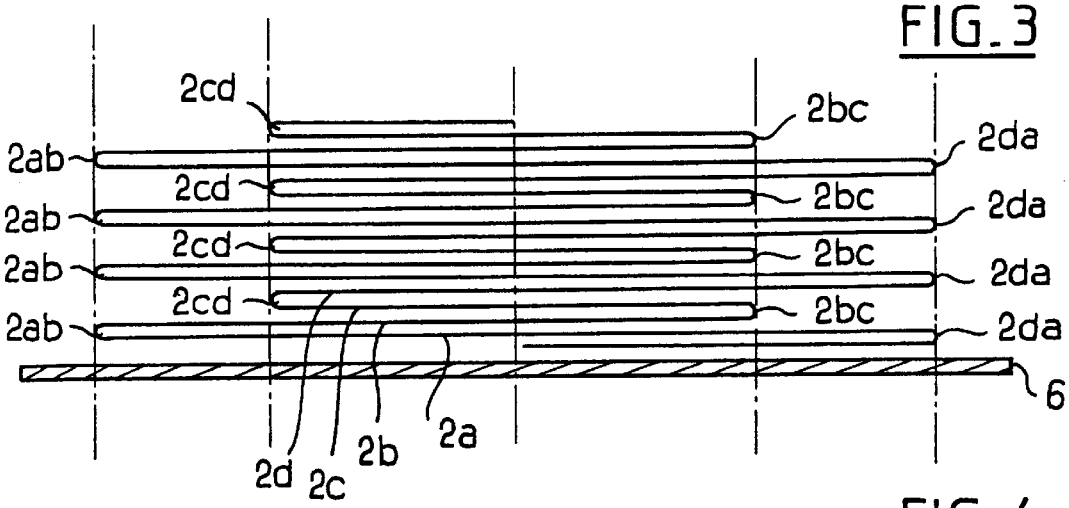
FIG. 3 is a diagrammatic cross-sectional view along III—III of FIG. 2.
Figure 4:
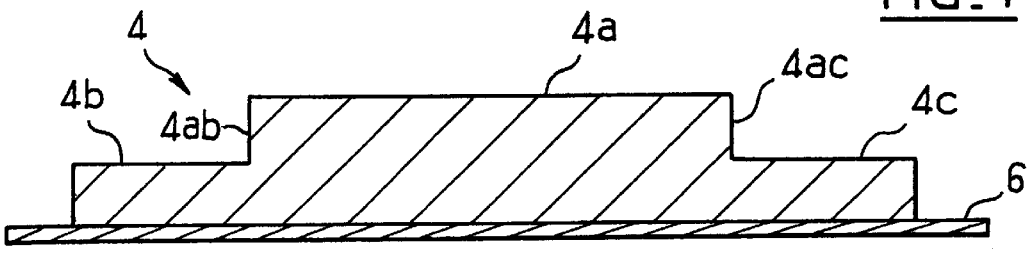
FIG. 4 is a diagrammatic view showing the fleece profile obtained with the lapping pattern illustrated in FIG. 3.

FIG. 3 shows the folding scheme of the web 2 on the output conveyor 6. FIG. 4 shows the fleece profile obtained, with a shoulder 4*ab* and 4*ac* between the central zone 4*a* and each lateral strip 4*b*, 4*c*. The shoulders 4*ab*, 4*ac* are formed along the folds 2*cd*, 2*bc* respectively. The distinctness with which the shoulders 4*ab*, 4*ac* appear is of course exaggerated in FIG. 4, particularly as the web 4 has not been subjected to consolidation and compacting treatment such as needling.

The thickness variations of the fleece correspond to corresponding variations of the weight per unit of area along the transverse profile of the fleece.

In order that the crosslapper can execute the lapping method which has been described, a programming step is added during the preparations for operating the crosslapper by means of the programming console 31. This step consists in asking the user to define the sequence of travels which the lapping carriage must carry out in order to produce the lapping pattern. The user may, for example, have to define the number of reversals of motion of the carriage (number of folds of the pattern) and the position of each of these direction reversals (positions of the folds of the pattern) with respect to the transverse dimension of the output conveyor 6. The taking into account of such instructions by the crosslapper and in particular by the control unit 29 is within the capability of those skilled in the art since commercial crosslappers are capable of working with different web widths. As the rules for reconciling the imperatives of alternating motion of the lapping carriage 21 with those of the continuous feed of the web 2 by the supply conveyor belt 1 are known in the form of equations in particular according to FR-A-2 234 395, those skilled in the art know how to design a control unit 29 capable of calculating for each different travel of the carriage 21, the corresponding controls to be applied at all times to the various motors of the crosslapper.

Knowing the supply speed of the web 2 and the total distance which the lapping carriage 21 must travel in order to execute the lapping pattern, the time necessary for executing the lapping pattern is known. It is desirable that this time should correspond to the division by an integer (n) of the time necessary for the output conveyor 6 to move over a distance "L" (FIG. 2) corresponding to the dimension of the web 2 measured in the longitudinal direction of the output conveyor 6. Thus, as can be observed at the right edge of the fleece 4 in FIG. 2, each new segment of web 2 encountered on the top of the fleece when moving longitudinally over the fleece coincides with an identical segment which is terminated on the lower face of the fleece. With such a configuration, the number of thicknesses of web is the same along each longitudinal line of the fleece 4. In other words, the lateral edges of the web 2 do not form any variation in thickness along the fleece 4. During programming, it is advantageous that the user should choose the speed of the output conveyor 6 by setting the desired value "n". In the example shown in FIGS. 1 to 4, n=4, that is to say that the crosslapper executes 4 lapping patterns whilst the output conveyor 6 causes the fleece 4 to move over the distance L. As each pattern comprises four segments there are therefore, at all points in the length of the fleece, sixteen thicknesses of web in the central zone 4*a* and, consequently, only eight thicknesses in each lateral strip 4*b*, 4*c*.

In the example shown in FIGS. 3 and 4, each lapping pattern comprises a segment (2*a*), extending over the entire width of the fleece, a segment (2*b*) covering only the central zone 4*a*, and one of the lateral strips 4*b*, a segment (2*c*) covering only the central zone 4*a*, and a segment (2*d*) covering only the central zone 4*a* and the other lateral strip 4*b*.

Figure 5:
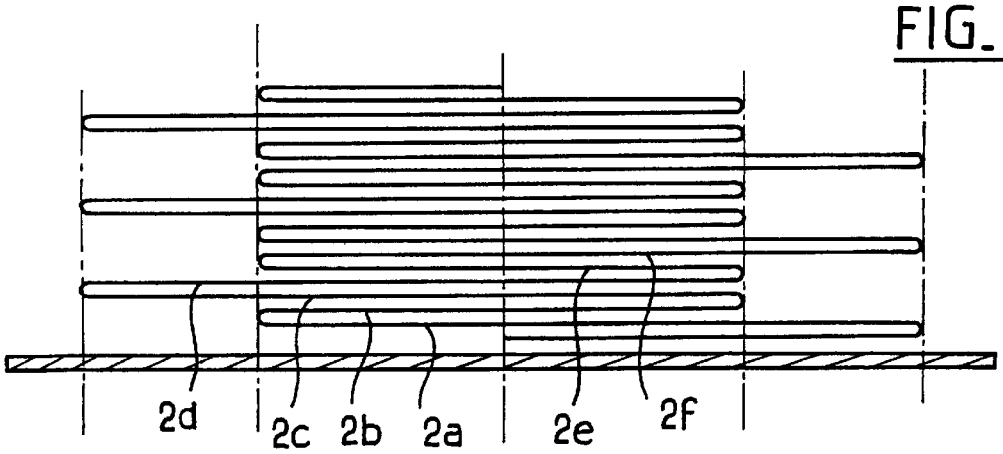
FIGS. 5, 7, 9, 11, 13, 15, 17 and 19 are views similar to that of FIG. 3 but relative to other lapping patterns.
Figure 6:
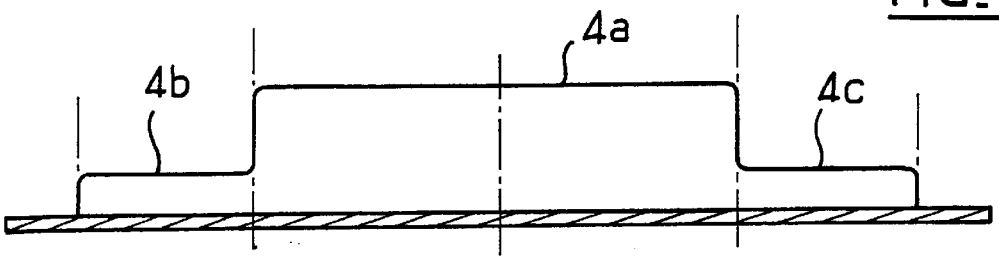
FIGS. 6, 8, 10, 12, 14, 16, 18 and 20 are views similar to that of FIG. 4 but relative to the lapping patterns illustrated in FIGS. 5, 7, 9, 11, 13, 15, 17 and 19 respectively.

In the example shown in FIGS. 5 to 6, each lapping pattern comprises six segments 2*a*–2*f*, among which the segments 2*f* and 2*a* cover the central zone 4*a* and one of the lateral strips 4*c*; two other successive segments 2*c* and 2*d* cover the central zone 4*a* and the other lateral strip 4*b*, whilst the segments 2*b* and 2*e* cover only the central zone 4*a*. The profile obtained is similar to that of FIGS. 3 and 4 except that the thickness of the lateral strips 4*b* and 4*c* is equal to one third of the thickness of the central strip 4*a*.

Figure 7:
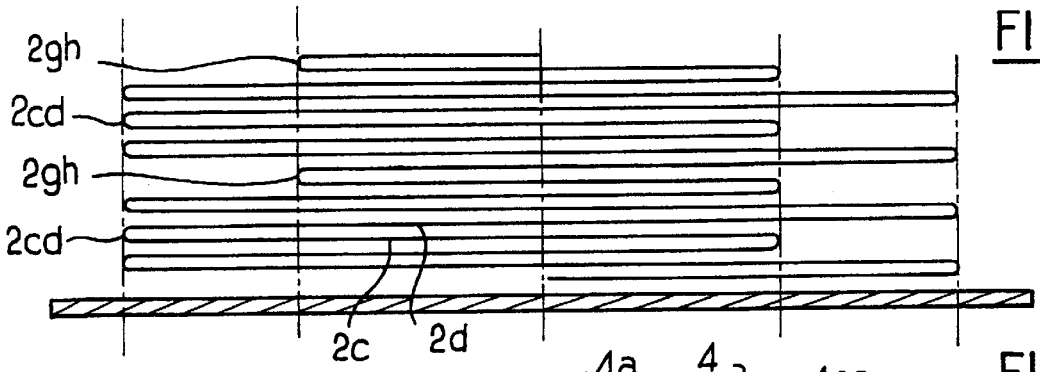
Figure 8:
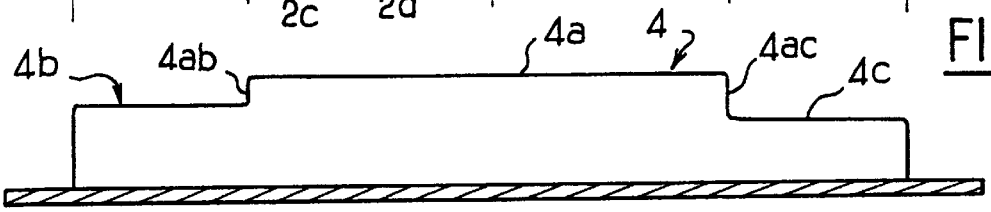

In the example shown in FIGS. 7 and 8, each lapping pattern corresponds to two successive lapping patterns as shown in FIG. 3, the only difference being that the fold 2*cd* is displaced from the shoulder 4*ab* up to the lateral edge of the fleece. The segments 2*c* and 2*d* which are connected by this fold are correspondingly lengthened. On the contrary, the fold 2*gh* corresponding to the other fold 2*cd* of the two successive lapping patterns of FIG. 3 still extend along the shoulder 4*ab*. In this way the asymmetrical fleece shown in FIG. 8 is produced in which the lateral strip 4*b* extending between the folds 2*cd* and 2*gh* is one and a half times thicker than the other lateral strip 4*b* which is, as before, two times thinner than the central zone 4*a*.

Figure 9:
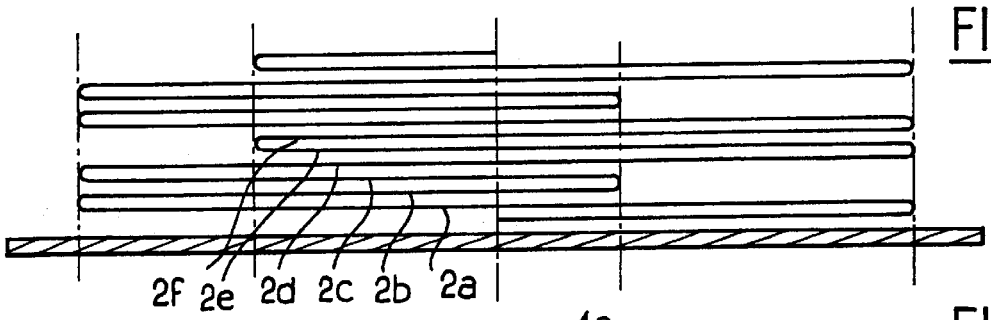
Figure 10:
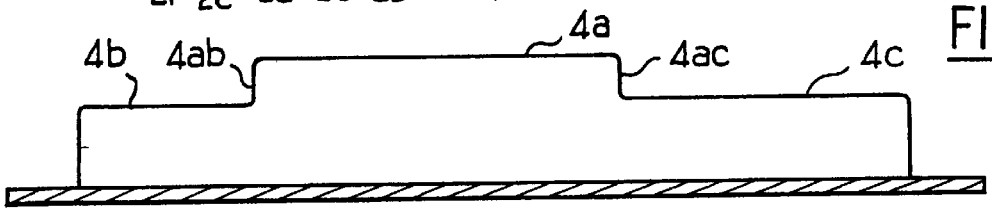

The example shown in FIGS. 9 and 10 shows that it is possible to avoid having to produce segments covering only the central thicker zone 4*a*. The lapping pattern consists of pairs of segments 2*b*, 2*c*; 2*e*, 2*f* corresponding to a forward and return motion of the web between one of the lateral edges of fleece and the shoulder 4*ac* and 4*ab* respectively which is most distant from that edge. These pairs are separated by segments 2*a*; 2*d* covering the entire width of the fleece. It is thus possible to produce an extra thickness 4*a* having a very reduced width without the lapping carriage at any time having to carry out such a reduced travel between two reversals of its direction of motion. Such a reduced travel of the lapping carriage could cause anomalies in the depositing of the web 2.

The example shown in FIGS. 9 and 10 also shows that the disposition of the shoulders 4*ab* and 4*ac* is not necessarily symmetrical with respect to the longitudinal axis of the fleece.

Figure 11:
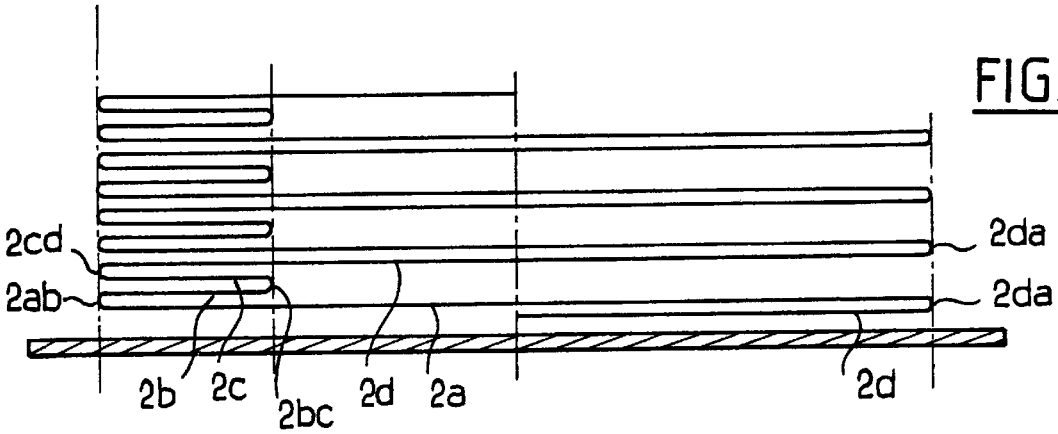
Figure 12:
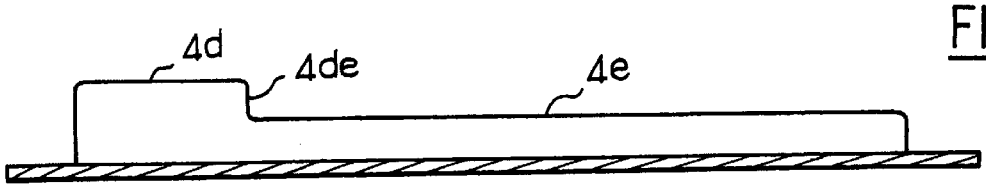

In the example shown in FIGS. 11 and 12, all of the folds in one of the directions 2*ab*, 2*cd*, are adjacent to a first lateral edge of the fleece. One of the folds 2*bc* in the other direction is adjacent to the other lateral edge of the fleece. The other fold 2*da* in the said other direction coincides with a shoulder 4*de* formed by the fleece between a lateral extra thickness 4*d*, and a thinner zone 4e of the fleece. The extra thickness 4*d* is adjacent to the first lateral edge of the fleece between the folds 2*ab* and 2*cd* on one side and the folds 2*bc* on the other.

Figure 13:
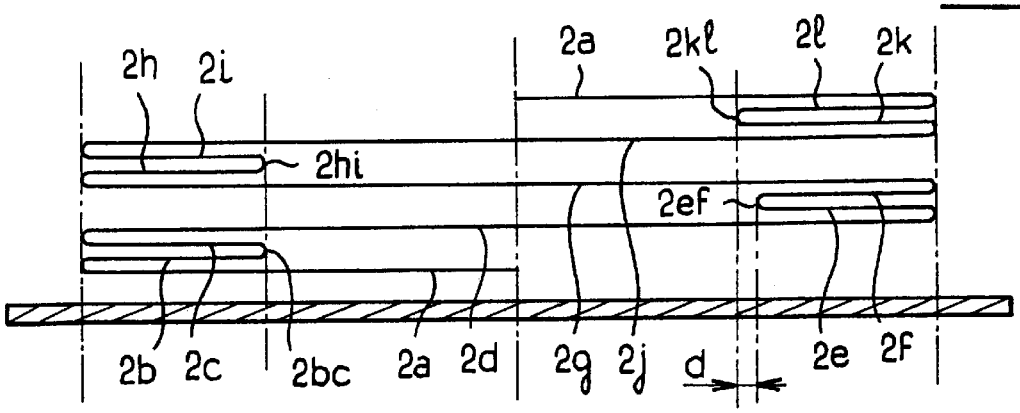
Figure 14:
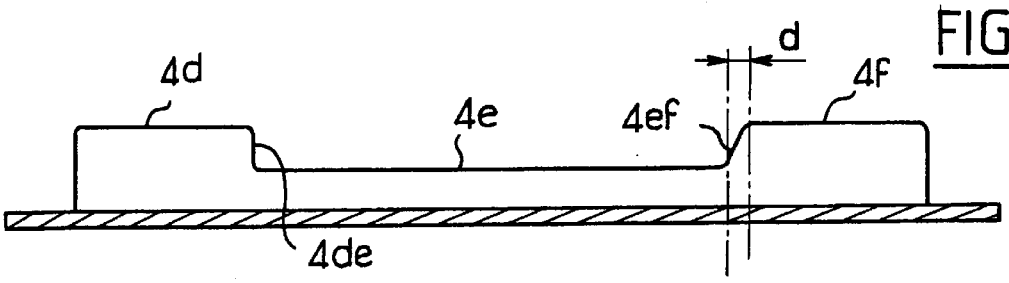

The example shown in FIGS. 13 and 14 shows that it is possible to produce an extra thickness 4*d* and 4*f* respectively along each lateral edge of the fleece, on either side of a thinner central zone 4*e*. The lapping pattern consists of two half-patterns each of which is the same as in FIG. 9 except that the segments 2*b*, 2*c*, 2*h* and 2*i* covering only a portion of the width of the fleece, starting from one of the lateral edges of the latter, have an amplitude too small for them to overlap the segments 2*e*, 2*f*, 2*k* and 21 covering only a portion of the width of the fleece starting from the other lateral edge of the latter. In the central zone 4*e* there are therefore only the segments 2*a*, 2*d*, 2*g*, 2*j* covering the entire width of the fleece.

According to another feature of this embodiment, the lateral strip 4*d* is delimited by a relatively sudden shoulder 4*de* since the folds 2*bc* and 2*hi* which form it in each lapping pattern are exactly superimposed. On the contrary, the shoulder 4*ef* separating the other lateral strip 4*b* from the central zone 4*a* is softened because there is a slight lateral offset "d" between the folds 2*ef* and 2*kl* which form this shoulder. Apart from this offset between the folds 2*ef* and 2*kl*, the two lapping half-patterns of FIG. 13 are identical.

Figure 15:
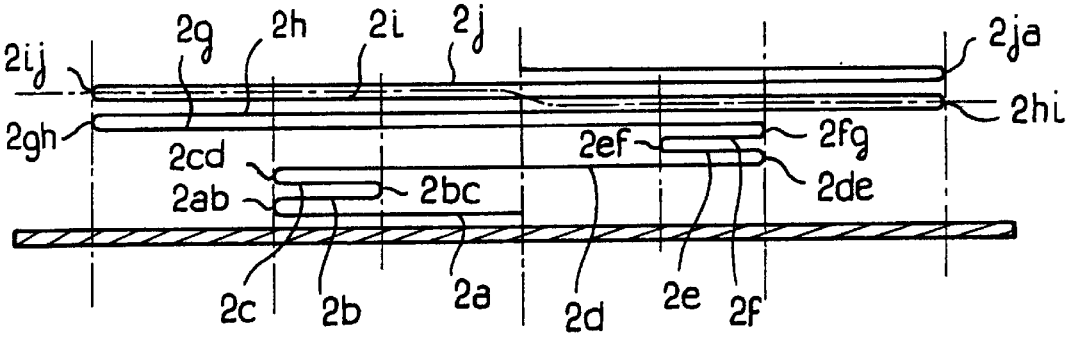
Figure 16:
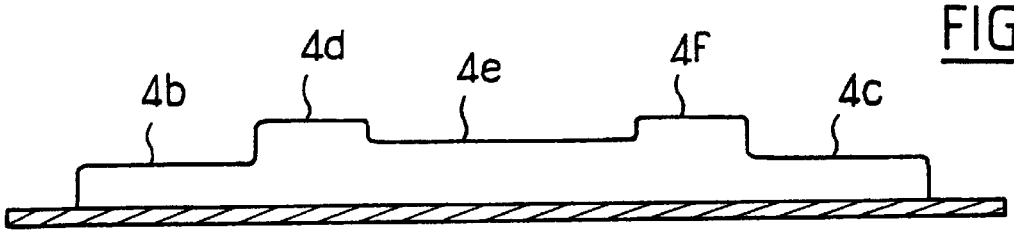

In the example shown in FIGS. 15 and 16, which will be described only where it differs with respect to a half-pattern of FIGS. 13 and 14, the extra thicknesses 4*d* and 4*f* are offset towards the inside of the fleece by corresponding offset of the segments 2*b* and 2*c* and of the folds 2*ab*, 2*bc* and 2*cd* which delimit them. The same applies to the segments 2*e* and 2*f* and the folds 2*de*, 2*ef* and 2*fg* which delimit them. Furthermore, the lapping pattern comprises folds 2*gh*, 2*hi*, 2*ij* and 2*ja* adjacent to the lateral edges of the fleece, and segments connecting these folds with each other and with the rest of the lapping pattern. The profile obtained is the one shown in FIG. 16, with lateral strips 4*b* and 4*c* of small thickness, a central zone 4*e* of medium thickness and, between the central zone 4*e* and each lateral strip 4*b* or 4*c*, an extra thickness 4*d* or 4*f* forming a kind of rib whose width varies according to the amplitude given to the segments 2*b*, 2*c*, 2*e* and 2*f*.

Figure 17:
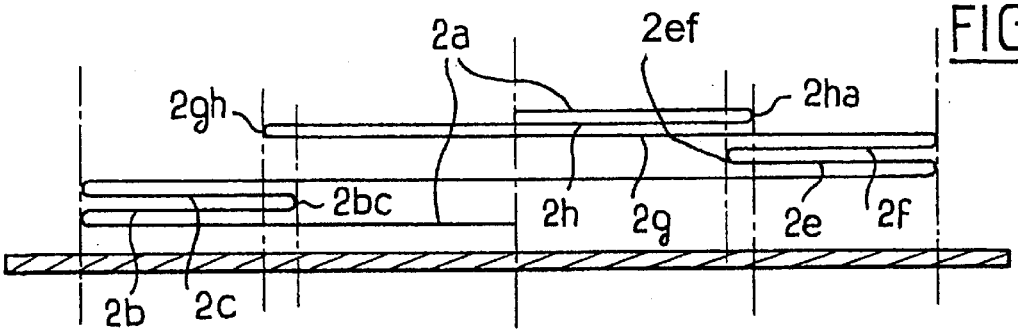
Figure 18:
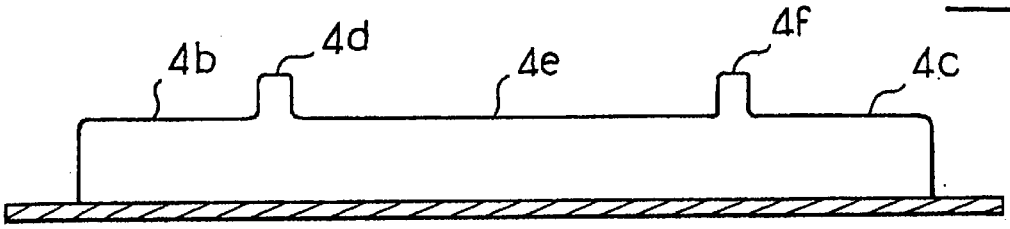

The example shown in FIGS. 17 and 18 corresponds to another embodiment for forming two longitudinal ribs 4*d* and 4*f* each one located at a certain distance from the longitudinal edge of the fleece. The lapping pattern corresponds to a half-pattern of FIGS. 13 and 14 but in which the segment 2*a* is replaced by three segments 2*g*, 2*h* and 2*a*. The segment 2*h* has a terminal zone which overlaps the segments 2*e* and 2*f* and another terminal zone which overlaps the segments 2*b* and 2*c* in order to form the extra thicknesses 4*d* and 4*e* respectively, which can therefore have a very small width for the same reasons as the extra thickness 4*a* of FIGS. 9 and 10.

Each extremity of the segment 2*h* is connected with the opposite lateral edge of the fleece by a fold 2*gh* and 2*ha* respectively and a segment 2*g* and 2*a* respectively. The folds 2*gh* and 2*ha* form the outer longitudinal edges of the ribs 4*d* and 4*f* respectively, whilst the folds 2*bc* and 2*ef* define the inner longitudinal edges of the said ribs.

Figure 19:
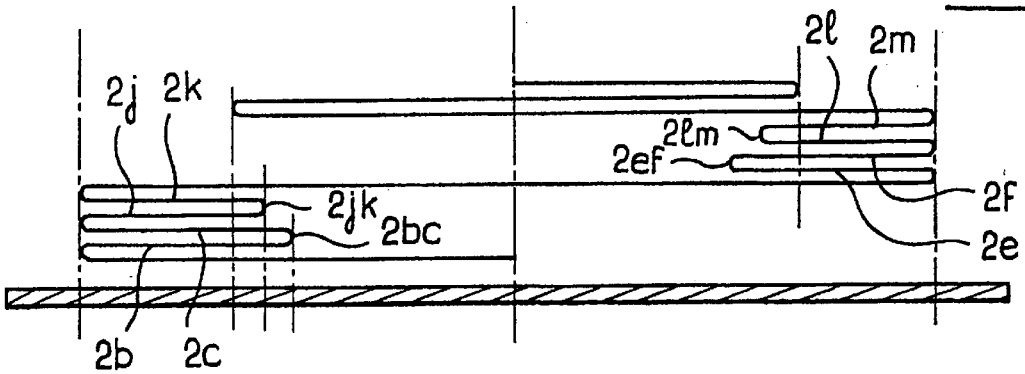
Figure 20:
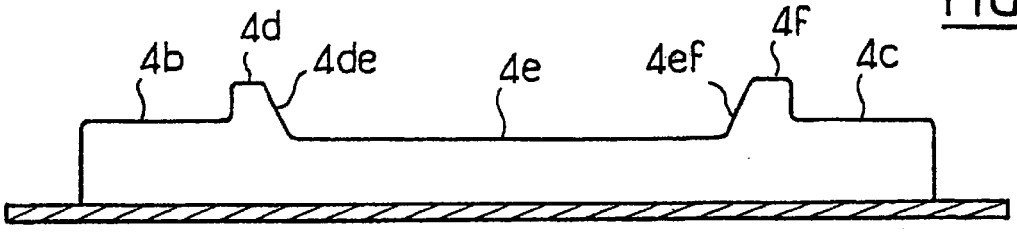

The example shown in FIGS. 19 and 20 is identical with the one shown in FIGS. 17 and 18 except that, in each lapping pattern, each pair of segments 2*b*, 2*c*; 2*e*, 2*f* covering only a lateral strip and an adjacent rib 4*b* and 4*d*; 4*f* and 4*c* is replaced by two superimposed pairs 2*b*, 2*c* and 2*j*, 2*k*; 2*e*, 2*f* and 21, 2*m*. The effect of this is to make the lateral stirps 4*b* and 4*c* thicker than the central zone 4*e*. Furthermore, the folds 2*bc* and 2*jk*; 2*ef* and 2*lm*, which limit the superimposed pairs on the side facing the inside of the fleece, are offset with respect to each other such that the shoulders 4*de* and 4*ef* between the central zone 4*e* and the ribs 4*d* and 4*f* respectively are softened into a chamfer as shown in FIG. 20.

Figure 21:
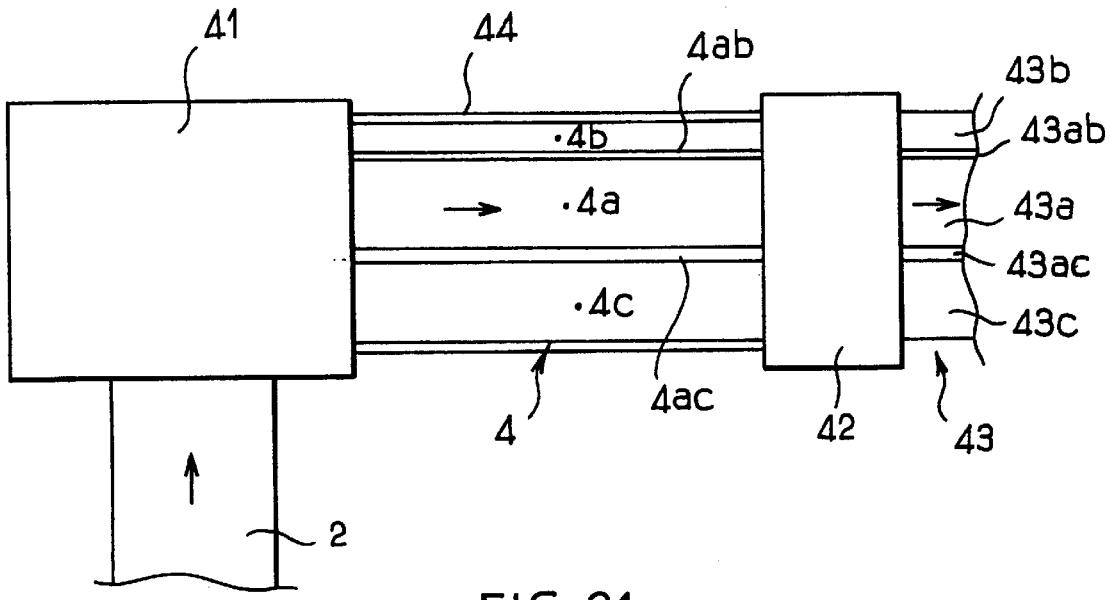
FIG. 21 is a view of the device for producing a continuous textile product according to the invention.
Figure 22:
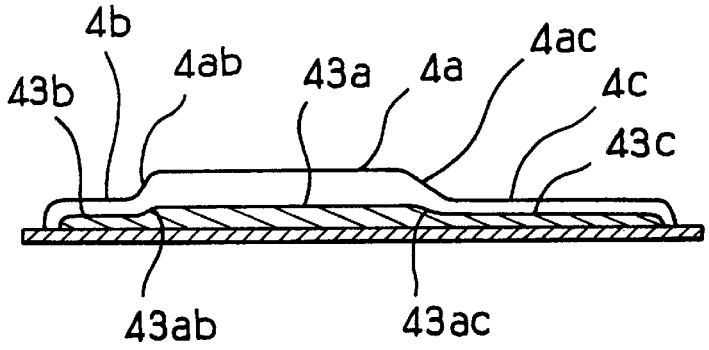
FIG. 22 is a view allowing to compare the transverse profile of the textile product at the outlet of the crosslapper and at the outlet of the consolidation machine, respectively.

FIG. 21 illustrates that at the outlet of the crosslapper 41 which can be the crosslapper of FIGS. 1 and 2, the fleece 4 with in this example three zones 4*a*, 4*b*, 4*c* separated by two shoulders 4*ab* and 4*ac* is guided by appropriate means which are symbolised by reference numeral 44, into a consolidating machine 42, typically a needle punching machine. The means 44 are at least in part provided by the conveyor 6 of the crosslapper. The stepped non-uniform profile produced by the crosslapper 41 is still in a transverse orientation during its passage through the needle punching machine 42. This especially means that the fleece 4 is not subjected to any intermediate process such as a second crosslapping which would change this orientation. More specifically, as seen from above as in FIG. 21, the textile product moves along a straight line from the outlet of the crosslapper 41 to the inlet into the needle punching machine 42. Intermediate processings between the crosslapper 41 and the needle punching machine 42 are not excluded. They can for example consist in a pre-needling, an intermediate storage, etc. But it is important that the transverse profile of the product entering the needle punching machine 42 keeps the trace of the transverse profile performed by the crosslapper 41. Thus, at the outlet of the needle punching machine 42, the textile product which is obtained has a profile in which, essentially, the profile resulting from the crosslapping is still present, with in the example three zones of constant thickness 43*a*, 43*b*, 43*c*, separated by two shoulders 43*ab* and 43*ac*, although the needle punching machine has considerably compacted the profile.

The invention is not of course limited to the examples described and shown, whose purpose is not to give an exhaustive list of possibilities but to show by which means the relative thicknesses, the symmetries and asymmetries, the number of areas of different thicknesses and the mode of transition between two areas of different thickness can be varied virtually infinitely by the methods and the devices according to the invention. As a simple example, it would be possible, starting from the embodiment shown in FIG. 11, to obtain a fleece having three different thicknesses which decrease from the left lateral edge to the right lateral edge of the fleece. To achieve this it would suffice that every other fold 2*bc* be offset towards the right lateral edge of the fleece, or that every other fold 2*da* be offset towards the left edge of the fleece. The cumulation of these two possibilities would even allow the possibility of producing four progressively decreasing thicknesses.

The invention is compatible with any arrangement for varying the thickness, in particular the degree of positive or negative stretching, of the web deposited on the output conveyor, This makes it possible to combine the more or less sudden variations of thickness due to the invention with more progressive variations between different points in the width of a same thickness zone defined by the invention.

What is claimed is:

1. A method of producing a continuous textile product comprising:

feeding a fiber web;

depositing successive segments of said fiber web in a transverse direction on an output conveyor while actuating said output conveyor in a longitudinal direction, forming web folds alternatively in one direction and in the other direction by reversing the transverse direction of deposition when finishing deposition of a segment and beginning deposition of a next segment, thereby forming on said output conveyor a fiber fleece having a transverse profile and composed of web segments connected to one another by said folds, said fiber fleece having two opposed longitudinal edges along each of which some said folds extend;

during said forming web folds, positioning others of said folds along a longitudinal line located at a distance between said two opposed longitudinal edges, thereby to provide the fiber fleece with a stepped transverse profile having at least two substantially flat longitudinal zones of different thickness on either side of said longitudinal line being a step line;

consolidating said fleece while said transverse profile is in a transverse orientation with respect to a travelling direction through a consolidation apparatus.

2. A method according to claim 1, comprising adjusting the speed of the output conveyor in said forward direction such that the displacement of the output conveyor during execution of a lapping pattern corresponds to 1/n time the width of the web, "n" being an integer.

3. A method according to claim 1, comprising in order to produce a thicker zone between two longitudinal steps separating said thicker zone from two thinner zones of the profile of the fleece, depositing two kinds of web segments, each said kind of web segments being deposited between a fold adjacent to a respective one of said longitudinal steps and extending over the thinner zone remote from this step.

4. A method according to claim 1, comprising in order to produce a thicker zone adjacent to at least one thinner zone of the profile of the fleece, depositing shorter segments which are delimited by two folds each located along one of the longitudinal edges of the thicker zone and longer segments covering the entire thicker zone and said thinner zone beyond one of the longitudinal edges of said thicker zone.

5. A method according to claim 4, comprising depositing said shorter and said longer segments adjacent to an edge of the fleece.

6. A method according to clam 1, comprising producing a progressive change of thickness at said step line between said two zones by depositing superimposed segments of web limited along said stepline by slightly offset folds of a same direction.

7. A method according to claim 1, comprising programming a lapping pattern corresponding to a certain number of successive segments by predefining positions of a succession of said web folds along the width of the output conveyor and effecting said forming web folds by repetitively forming said succession of said web folds.

8. A method according to claim 1, comprising forming all the folds in one direction in dissymetric positions with respect to some of said folds in the other direction, with regard to a vertical center line of the cross-sectional shape of the fiber fleece.

9. A method according to claim 1, comprising displacing the fiber fleece, as seen from above, along a straight line from said forming the fleece up to and into said consolidation apparatus.

10. A method according to claim 1, wherein said step of consolidating is a step of needling.

11. A method according to claim 1, wherein said two substantially flat longitudinal zones with different thickness remain on either side of the same said longitudinal step line after consolidation but are each of reduced thickness after said consolidation.

12. A method according to claim 1, comprising in order to produce a thicker zone adjacent to two thinner zones of the profile of the fleece, depositing shorter segments which are delimited by two folds each located along one of the longitudinal edges of the thicker zone and longer segments extending beyond both said longitudinal edges of the thicker zone and over said two thinner zones.

13. A plant for manufacturing a continuous textile product comprising:

a) a crosslapper comprising:

an output conveyor;

a carriage which is transversely movable above the output conveyor;

means for actuating the carriage along travels in each direction of the width of the output conveyor, said travels being separated by reversals of travelling direction;

means for supplying the carriage with a continuous fiber web;

means carried by the carriage for feeding the fiber web onto the output conveyor;

fleece-profiling means comprising means for positioning at different locations in the width of the output conveyor at least certain of the successive reversals in the travelling direction of the carriage starting from a same travelling direction of the carriage, thereby to provide the fleece with a stepped transverse profile;

b) a consolidation machine arranged downstream the output conveyor of said crosslapper so that said stepped transverse profile of the fleece is disposed transversely of travelling direction of said fiber fleece through the consolidation machine.

14. A plant according to claim 13, comprising means for selectively programming a sequence of travels defined by the positions of extremities of said travels with respect to the width of the output conveyor; and means for controlling the carriage such that it repetitively executes the sequence of travels.

15. A plant according to claim 13, comprising means for causing the output: conveyor to progress by L/n during the execution of each sequence, in which expression "L" is the dimension of the web measured parallel with the length of the output conveyor and "n" is an integer.

16. A plant according to claim 13, wherein said programming means predefine an asymmetrical cross-sectional shape of the fleece.

17. A plant according to claim 13, wherein said stepped profile immediately downstream of said consolidation machine is the same as said stepped profile immediately downstream of said crosslapper, but thinner.

18. A crosslapper comprising:

an output conveyor;

a carriage which is transversely movable above the output conveyor;

means for actuating the carriage along travels in each direction of the width of the output conveyor said travels being separated by reversals of travelling direction;

means for supplying the carriage with a continuous fiber web;

means carried by the carriage for feeding the fiber web onto the output conveyor;

fleece-profiling means comprising means for positioning at different locations in the width of the output conveyor at least certain of the successive reversals in the travelling direction of the carriage starting from a same travelling direction of the carriage;

programmation means for selectively programming a sequence of travels defined by the positions of their extremities with respect to the width of the output conveyor; and calculation and control means for determining and applying at each instant to a drive means of the carriage such a drive control that said carriage repetitively executes the sequence of travels.

19. A crosslapper according to claim 18, comprising means for causing the output conveyor to progress by L/n during the execution of each sequence, in which expression "L" is the dimension of the web measured parallel with the length of the output conveyor and "n" is an integer.

20. A crosslapper according to claim 18, wherein said programming means predefine an asymmetrical cross-sectional shape of the fleece.

21. A continuous textile product having two opposed longitudinal edges and comprising successive transverse fiber web segments which partially overlap each other, each segment being connected by two web folds to an underlying segment and to an overlying segment respectively, wherein some of said folds extend along at least one longitudinal step line of the fleece, said longitudinal step line extending at a distance from both longitudinal edges of the fleece and corresponding to a change of thickness between two longitudinal substantially flat zones of the fleece which have different thicknesses, and wherein the superposed segments are secured to each other by a consolidation bond.

22. A continuous textile product according to claim 21, wherein said some of said folds comprise mutually offset folds along a same longitudinal step line, so as to provide some progressivity in the change of thickness.

23. A continuous textile product according to claim 21, wherein some of said segments extend from one longitudinal edge of a thicker zone of the fleece and over a first thinner zone beyond the other longitudinal edge of the thicker zone, and others of said segments extend from said other longitudinal edge and over a second thinner zone beyond said one longitudinal edge.

24. A continuous textile product according to claim 21, wherein the cross-sectional shape of the fiber fleece is asymmetric with respect to a vertical median line of the fiber fleece.

25. A continuous textile product according to claim 21, wherein as said consolidation bond, said product is a needled product.

26. A method of producing a continuous textile product having a stepped transverse profile, comprising the step of needling a fiber fleece made of segments connected together by folds some of which extend along at least one longitudinal line which is spaced apart from both sides edges of said fiber fleece.

27. A method of producing a continuous textile product comprising:

feeding a fiber web;

depositing successive segments of said fiber web in a transverse direction on an output conveyor while actuating said output conveyor in a longitudinal direction, forming web folds alternately in one direction and in the other direction by reversing the transverse direction of deposition when finishing deposition of a segment and beginning deposition of a next segment, thereby forming on said output conveyor a fiber fleece having a transverse profile and composed of web segments connected to one another by said folds, said fiber fleece having two opposed longitudinal edges along each of which some said folds extend;

during said forming web folds, positioning others of said folds along a longitudinal line located at a distance between said two opposed longitudinal edges, thereby to provide the fiber fleece with a stepped transverse profile having at least two substantially flat longitudinal zones of different thickness on either side of said longitudinal line, said longitudinal line being a step line;

consolidating said fleece while said transverse profile is in a transverse orientation with respect to a travelling direction through a consolidation apparatus;

adjusting the speed of the output conveyor in said longitudinal direction such that the displacement of the output conveyor during execution of a lapping pattern corresponds to 1/n time the width of the web, "n" being an integer.

28. A method according to claim 27, comprising in order to produce a thicker zone between two longitudinal steps separating said thicker zone from two thinner zones of the profile of the fleece, depositing two kinds of web segments, each said kind of web segments being deposited between a fold adjacent to a respective one of said longitudinal steps and extending over the thinner zone remote from this step.

29. A method according to claim 27, comprising in order to produce a thicker zone adjacent to at least one thinner zone of the profile of the fleece, depositing shorter segments which are delimited by two folds each located along one of the longitudinal edges of the thicker zone and longer segments covering the entire thicker zone and said thinner zone beyond one of the longitudinal edges of said thicker zone.

30. A method according to claim 29, comprising depositing said shorter and said longer segments adjacent to an edge of the fleece.

31. A method according to claim 27, comprising in order to produce a thicker zone adjacent to two thinner zones of the profile of the fleece, depositing shorter segments which are delimited by two folds each located along one of the longitudinal edges of the thicker zone and longer segments extending beyond both said longitudinal edges of the thicker zone and over said two thinner zones.

32. A method according to claim 27, comprising producing a progressive change of thickness at said step line between said two zones by depositing superimposed segments of web limited along said step line by slightly offset folds of a same direction.

33. A method according to claim 27, comprising programming a lapping pattern corresponding to a certain number of successive segments by predefining positions of a succession of said web folds along the width of the output conveyor and effecting said forming web folds by repetitively forming said succession of said web folds.

34. A method according to claim 27, comprising forming all the folds in one direction in dissymetric positions with respect to some of said folds in the other direction, with regard to a vertical center line of the cross sectional shape of the fiber fleece.

35. A method according to claim 27, comprising displacing the fiber fleece, as seen from above, along a straight line from said forming the fleece up to and into said consolidation apparatus.

36. A method according to claim 27, wherein said step of consolidating is a step of needling.

37. A method according to claim 27, wherein said two substantially flat longitudinal zones with different thickness remain on either side of the same said longitudinal step line after consolidation but are each of reduced thickness after said consolidation.

38. A plant for manufacturing a continuous textile product comprising:

a) a crosslapper comprising:

an output conveyor;

a carriage which is transversely movable above the output conveyor;

means for actuating the carriage along travels in each direction of the width of the output conveyor, said travels being separated by reversals of travelling direction;

means for supplying the carriage with a continuous fiber web;

means carried by the carriage for feeding the fiber web onto the output conveyor;

means for causing the output conveyor to progress by L/n during the execution of each sequence, in which expression "L" is the dimension of the web measured parallel with the length of the output conveyor and "n" is an integer;

fleece-profiling means comprising means for positioning at different locations in the width of the output conveyor at least certain of the successive reversals in the travelling direction of the carriage starting from a same travelling direction of the carriage, thereby to provide the fleece with a stepped transverse profile;

b) a consolidation machine arranged downstream the output conveyor of said crosslapper so that said stepped transverse profile of the fleece is disposed transversely of a travelling direction of said fiber fleece through the consolidation machine.

39. A plant according to claim 38, comprising means for selectively programming a sequence of travels defined by the positions of extremities of said travels with respect to the width of the output conveyor; and means for controlling the carriage such that it repetitively executes the sequence of travels.

40. A plant according to claim 38, wherein said programming means predefine an asymmetrical cross sectional shape of the fleece.

41. A plant according to claim 38, wherein said stepped profile immediately downstream of said consolidation machine is the same as said stepped profile immediately downstream of said crosslapper, but thinner.

42. A crosslapper comprising:

an output conveyor;

a carriage which is transversely movable above the output conveyor means for actuating the carriage along travels in each direction of the width of the output conveyor said travels being separated by reversals of travelling direction;

means for supplying the carriage with a continuous fiber web;

means carried by the carriage for feeding the fiber web onto the output conveyor;

means for causing the output conveyor to progress by L/n during the execution of each sequence, in which expression "L" is the dimension of the web measured parallel with the length of the output conveyor and "n" is an integer;

fleece-profiling means comprising means for positioning at different locations in the width of the output conveyor at least certain of the successive reversals in the travelling direction of the carriage starting from a same travelling direction of the carriage.

programation means for selectively programming a sequence of travels defined by the positions of their extremities with respect to the width of the output conveyor; and calculation and control means for determining and applying at each instant to a drive means of the carriage such a drive control that said carriage repetitively executes the sequence of travels.

43. A crosslapper according to claim 42, wherein said programming means predefine an asymmetrical cross-sectional shape of the fleece.

* * * * *